US006838994B2

(12) United States Patent
Gutta et al.

(10) Patent No.: US 6,838,994 B2
(45) Date of Patent: Jan. 4, 2005

(54) ADAPTIVE ALARM SYSTEM

(75) Inventors: Srinivas Gutta, Buchanan, NY (US); Miroslav Trajkovic, Ossining, NY (US); Antonio J Colmenarez, Peekskill, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 47 days.

(21) Appl. No.: 10/043,382

(22) Filed: Oct. 26, 2001

(65) Prior Publication Data

US 2003/0080872 A1 May 1, 2003

(51) Int. Cl.[7] ..... G08B 23/00; G04B 47/00; G04C 21/16

(52) U.S. Cl. ..... 340/575; 340/573.1; 368/10; 368/245

(58) Field of Search ..... 340/573.1, 575, 340/576; 368/10–12, 72–74, 245, 250

(56) References Cited

U.S. PATENT DOCUMENTS 3,727,395 A * 4/1973 Baylor ..... 368/256
3,922,665 A * 11/1975 Curry et al. ..... 180/272
4,763,310 A * 8/1988 Goetzberger ..... 368/205
4,894,813 A * 1/1990 Pacher et al. ..... 368/256
5,008,865 A * 4/1991 Shaffer et al. ..... 368/10
5,373,488 A * 12/1994 Lidor ..... 368/13
5,524,101 A * 6/1996 Thorgersen et al. ..... 368/10
5,570,698 A * 11/1996 Liang et al. ..... 600/558
5,708,627 A * 1/1998 Gormley ..... 368/10
5,714,847 A * 2/1998 Lindauer et al. ..... 315/307
5,815,077 A * 9/1998 Christiansen ..... 340/573.3
5,883,577 A * 3/1999 Jordan et al. ..... 340/628
6,016,099 A * 1/2000 Campman ..... 340/321
6,081,949 A * 7/2000 Delicia ..... 5/639
6,111,580 A * 8/2000 Kazama et al. ..... 345/863
6,236,621 B1 * 5/2001 Schettino ..... 368/10
6,236,622 B1 * 5/2001 Blackman ..... 368/10
6,304,187 B1 * 10/2001 Pirim ..... 340/576

OTHER PUBLICATIONS

The American Heritage Dictionary ot the English Language: Fourth Edition, 2000: Determination of "behavior", 1 page.*

* cited by examiner

*Primary Examiner*—Jeffery Hofsass
*Assistant Examiner*—Anne V. Lai
(74) *Attorney, Agent, or Firm*—Edward W. Goodman

(57) ABSTRACT

This invention provides an alarm system and method for adjusting the wake-up signals. The system includes a means for tracking the behavior of a person in a predetermined area under surveillance after the activation of an alarm clock, and a means for determining whether the person is motionless for a predetermined time period. Upon recognition that the observed behavior indicates the person is still sleeping, the wake-up signals are gradually increased. At the same time, the electrical power supplied to a plurality of electronic devices may be increased to assist the person to wake up.

21 Claims, 3 Drawing Sheets

ADAPTIVE ALARM SYSTEM

BACKGROUND OF THE INVENTION

1. Field of the Invention

The present invention relates to an alarm clock system and, more particularly, to a method and system for gradually increasing or decreasing the alarm clock signals based on whether the person is awake after the activation of the alarm clock.

2. Description of the Related Art

Numerous types of alarm clocks have been developed in the prior art. Although many prior art systems serve the general purpose of providing sound or light sensitive to the human body, they would not be as suitable for the purpose of the present invention as described hereinafter.

Accordingly, the present invention provides an adaptive alarm system of automatically identifying a particular person after the alarm clock is activated, then making sure that the person awakes in a nonviolent manner.

SUMMARY OF THE INVENTION

The present invention is directed to a method and system for providing variations in wake-up signals and/or electrical power supplied to a plurality of electronic devices to assist a person in waking from sleep.

One aspect of the present invention provides a method for adjusting alarm clock signals by tracking the behavior of a person in a predetermined area after the activation of an alarm clock; determining whether the person is motionless for a predetermined time period; and, if motionless, gradually increasing the alarm clock signals. Thereafter, it is determined again whether the person is motionless, and if not, the alarm clock signals are gradually increased further. Otherwise, the alarm clock signals are gradually decreased. Alternatively, the electrical power supplied to a plurality of electronic devices electrically coupled to the alarm clock may be gradually increased or decreased based on whether the person is motionless after the activation of the alarm clock.

Another aspect of the present invention provides a method for adjusting the wake-up signals of an alarm clock system to assist in awaking a person. The method includes the steps of: setting a wake-up time in the alarm clock to activate the wake-up signals when the set time matches a current time; determining whether the person is motionless for a first predetermined time period after the activation of the alarm clock; if motionless, gradually increasing the wake-up signals of the alarm clock for a second predetermined time period; monitoring the behavior of the person for a third predetermined time period; and, if motionless, gradually increasing the wake-up signals of the alarm clock for a fourth predetermined time period.

Another aspect of the present invention provides an alarm clock system for adjusting wake-up signals. The system includes a detecting means for observing the behavior of a person in a predetermined area under surveillance; an analyzing means for analyzing output data from the detection means to determine whether the person is motionless for a predetermined time period; a speaker coupled to the analyzing means for producing the wake-up signals; a control means for generating a control signal to gradually increase or decrease the wake-up signals based on whether the person is motionless. The system further includes an adjusting means for adjusting the electrical power supplied to a plurality of electronic devices electrically coupled to the alarm clock system to assist the person to awake from sleep.

DETAILED DESCRIPTION OF THE DRAWINGS

A more complete understanding of the method and apparatus of the present invention is available by reference to the following detailed description when taken in conjunction with the accompanying drawings wherein.

DETAILED DESCRIPTION OF THE EMBODIMENTS

In the following description, for purposes of explanation rather than limitation, specific details are set forth such as the particular architecture, interfaces, techniques, etc., in order to provide a thorough understanding of the present invention. For purposes of simplicity and clarity, detailed descriptions of well-known devices, circuits, and methods are omitted so as not to obscure the description of the present invention with unnecessary detail.

Figure 1:
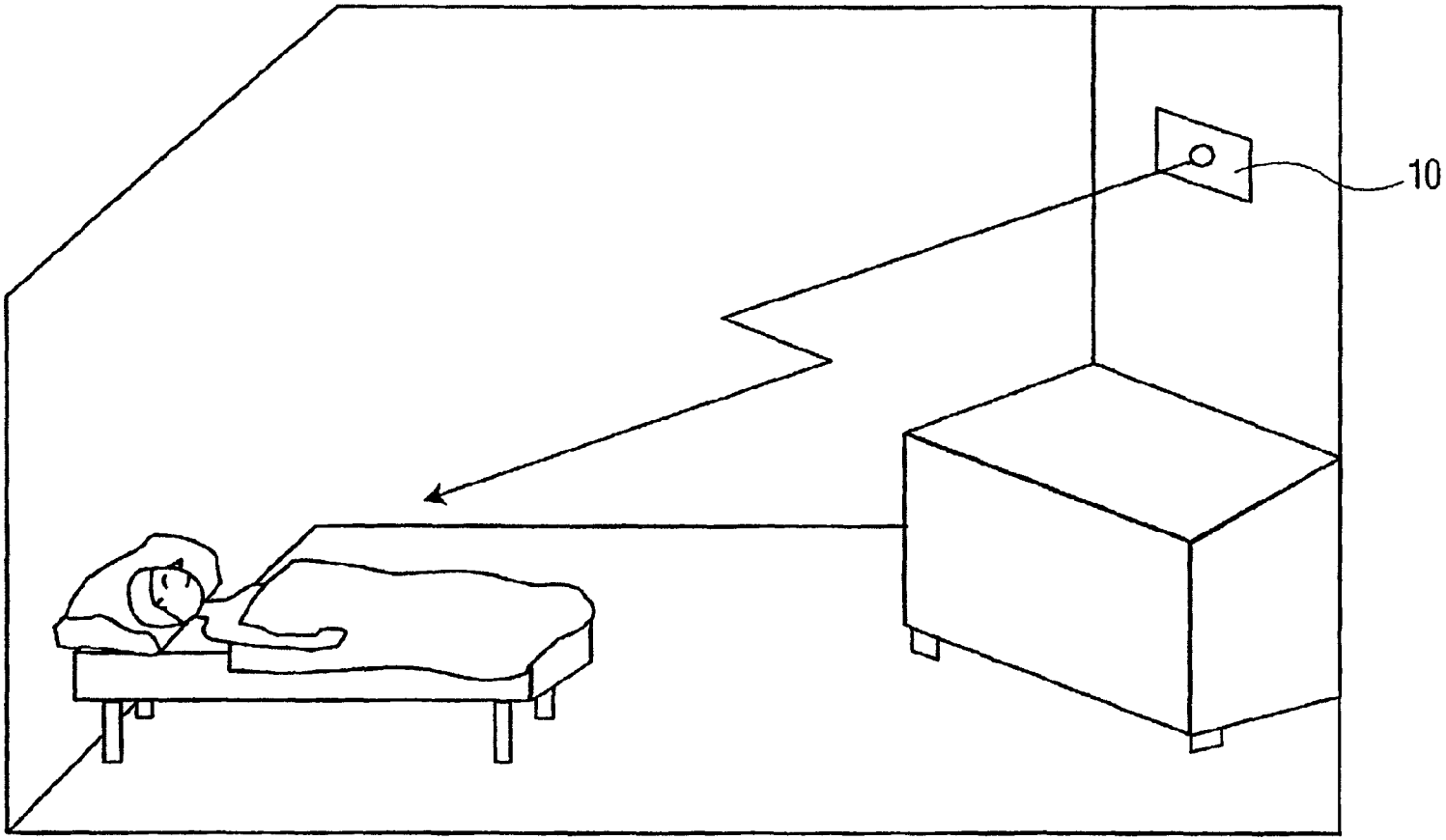
FIG. 1 is a simplified diagram illustrating an exemplary room whereto embodiments of the present invention are to be applied.

FIG. 1 is an illustrative diagram whereto embodiments of the present invention are to be applied. As shown in FIG. 1, the user is lying in bed with the alarm unit 10 positioned across the room from the bed. The alarm unit 10 may be located anywhere to keep a predetermined area or room under surveillance, such that if a person is still asleep after the activation of the alarm clock, the detection unit 10 generates a control signal to gradually increase the alarm signals, or activate other audio and visual signals via a number of electronic devices electronically coupled thereto, i.e., lamp, television set, stereo system, curtain or blinder opener/closer switch, etc. That is, a user may specifically pre-program the alarm unit 10 to selectively adjust the electrical power supplied to any one or a combination of the electronic devices coupled to the detection unit 10. For example, a user may pre-program the lamp or stereo system to be activated if the person is still asleep after the alarm clock is triggered. The lamp will simulate a sunrise to wake up the user as he or she may be very sensitive to external environmental conditions. Any combination of sounds that will gradually increase in volume over a preset period of time may be used as ambient sounds to assist the person in awaking from sleep.

Figure 2:
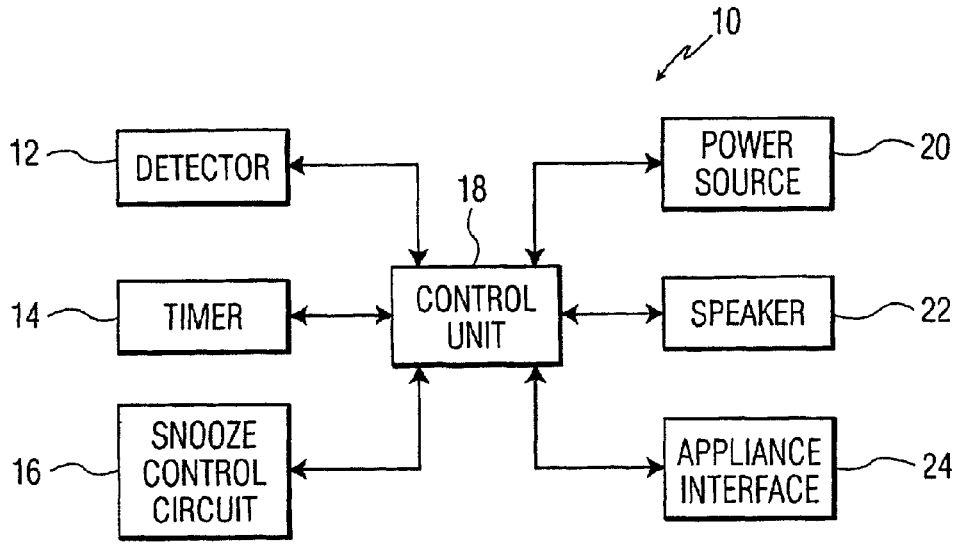
FIG. 2 is a simplified circuit block diagram showing an adaptive alarm system according to an embodiment of the present invention.

FIG. 2 illustrates a simplified block diagram of the alarm unit 10 according to an exemplary embodiment of the present invention. The detection unit 10 includes a detector 12, a timer 14, a snooze control circuit 16, a control processor 18, a power source 20, a speaker 22, an appliance interface circuit 24, and a time display (not shown). The detector 12 may include a video camera, an optical sensor, an infrared sensor that can sense the body heat, or other tracking systems that are capable of observing the human body movement or sensing the sounds of human activity. Thus, any number of commercially or publicly available detection systems can be utilized in various implementations in accordance with the preferred embodiment of the present invention.

The snooze control circuit 16 may be coupled to a number of control buttons that are typically found in the conventional alarm clock for setting the time of day and alarm. Typical buttons may include an hour button for setting the hour on the time display, a minute button for setting the minutes of the time display, and an alarm button for setting the alarm time and for generating an alarm signal if the time of day matches the time to which the alarm is set. The power source 20 is provided to send power to the control unit 18, which in turn distributes power to other components room, i.e., lamp, television set, stereo system, curtain or blinder opener/closer switch, etc. A memory (not shown) may also be provided to store various types of sounds that may be used as alternate wake-up signals.

In operation, the detector 12 determines whether the person in a room is still sleeping after the activation of the alarm sound. If movement of the person is not detected within a predetermined time period, the control unit 18 generates a control signal to the speaker 22 and/or the appliance interface 24 to gradually increase the sound volume of the speaker or to activate other devices that may provide audio or visual signals to assist the person in waking up. For example, the user can pre-program the alarm unit 10 to ring starting at 7:00 a.m. Next, the user can select the alarm to prompt the alarm sound to increase every 5 minutes. The user may select to activate other electronic devices, such as a television set or lamp, along with the alarm sound gradually increasing in volume over a five minute cycle.

Now, the process of identifying whether a person is still asleep after the activation of the initial alarm signal, according to the present invention, will be explained in a detailed description.

Figure 3:
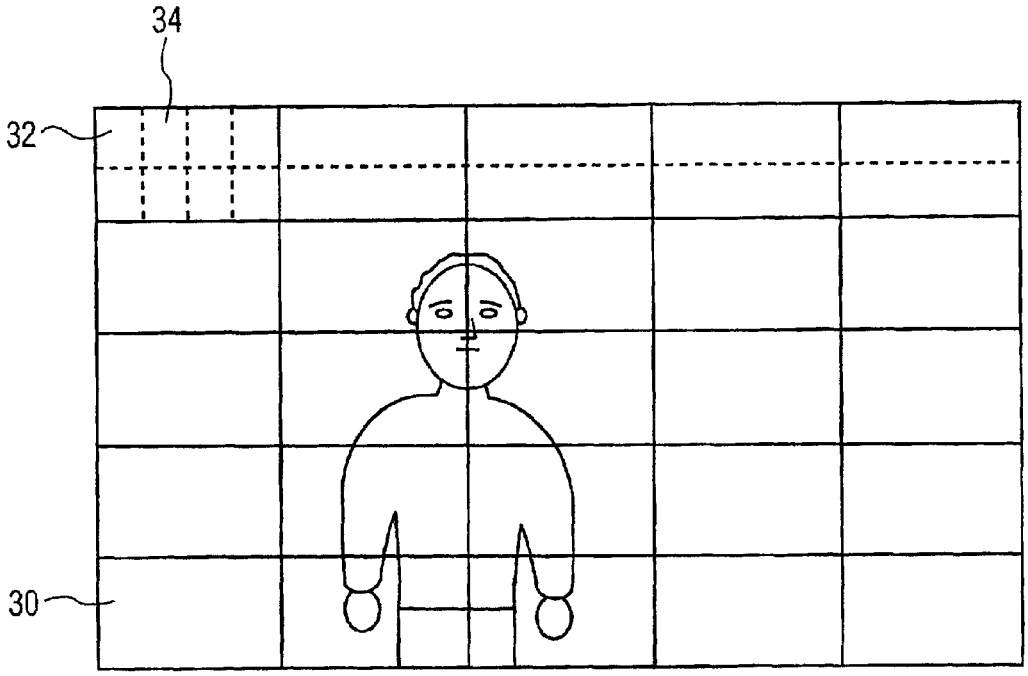
FIG. 3 is a diagram illustrating the pattern recognition function in accordance with the present invention; and, FIG. 4 is a flow chart illustrating the operation steps of gradually increasing and decreasing the wake-up sound in response to the movement of an individual according to an embodiment of the present invention.

FIG. 3 illustrates the technique of detecting the movement of a person in a room based on a series of frame data generated by the detector 12 of the inventive alarm unit 10. Tracking the movement of a person in a particular area is well known in the art which can be performed in a variety of ways. See for example, U.S. Pat. Nos. 4,249,207 and 6,095,989, the contents of which are hereby incorporated by reference. When using a video camera, for example, the area under surveillance could be divided into an array of cells as shown in FIG. 3. The content of each cell is monitored between frames for any changes in the adjacent cells, and such indication can be used to indicate the movement or non-movement of a person. The movement of a person could be determined by dividing the aisle into an array of cells 30. The array of cells could be further subdivided (shown by 32 and 34), for example, near the contour of the body region. The width of the subdivided cells also could be smaller, such that the movement of the person can be more easily identified. Accordingly, sub-divided cells could be used to detect a sleeping person by observing the person's motionless state. In the embodiment, if the detected person is motionless for a predetermined time period, it may indicate that the person is in a sleeping state.

Figure 4:
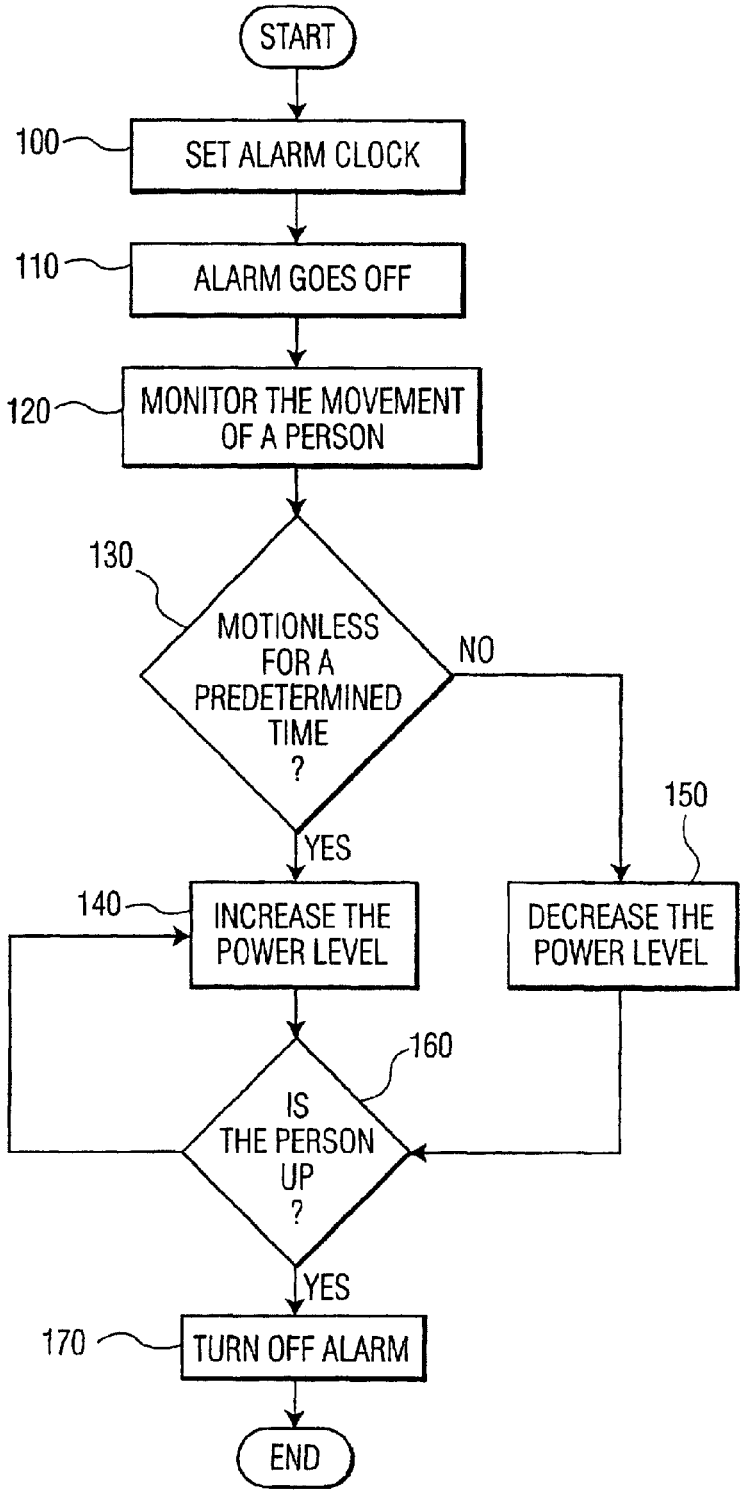

FIG. 4 illustrates a flow chart illustrating the operation steps of gradually increasing or decreasing the sound volume based on whether a person is still asleep in accordance with this invention. The rectangular elements indicate computer software instructions, whereas the diamond-shaped element represents computer software instructions that affect the execution of the computer software instructions represented by the rectangular blocks. Alternatively, the processing and decision blocks represent steps performed by functionally equivalent circuits such as a digital signal processor circuit or an application specific integrated circuit (ASIC).

In step 100, the user initially sets the alarm clock to activate at a particular time. When the current time matches the set alarm time, in step 110, the alarm clock is activated to assist the user in waking up. Thereafter, the alarm unit 10 tracks down a person in a room and generates a series of video frames in step 120. The movement of the person is monitored over a plurality of video frames to determine whether the person is moving within a predetermined time period in step 130. If the person is motionless, the processor 14 generates a control signal to increase the power level to the speaker 22 of the alarm unit 10 in step 140. Meanwhile, the electrical power supplied to any one of the electronic devices coupled to the alarm unit 10 can be activated to generate additional signals to assist the user in waking up. However, if the person is moving, the power level to the speaker 22 is gradually reduced in step 150. Thereafter, in step 160, if the person is determined to be awake, the power supplied to the electronic devices may be shut off or adjusted according to the default set by the user in step 170. Finally, if the person is determined to be not awake in step 160, step 140 is repeated.

The previous description of the preferred embodiments is provided to enable any person skilled in the art to make or use the present invention. Various modifications to these embodiments, and other embodiments, will be readily apparent to those skilled in the art without the use of the inventive faculty. Thus, the present invention is not intended to be limited to the embodiments shown herein but is to be accorded the widest scope consistent with the principles and novel features disclosed herein.

What is claimed is:

1. A method for adjusting alarm clock signals, the method comprising the steps of:

(a) tracking the overall behavior of a person in a predetermined area under surveillance after the activation of an alarm clock;

(b) determining whether the person is motionless within a first predetermined time period based on the results of said tracking; and (c) gradually increasing the alarm clock signals of said alarm clock if it is determined that the person is motionless.

2. The method as claimed in claim 1, wherein the method further comprises the steps of:

determining whether the person is motionless within a second predetermined time period; and further increasing the alarm clock signals of said alarm clock if it is determined that the person is motionless within said second predetermined time period.

3. The method as claimed in claim 1, wherein said method further comprises the step of:

gradually increasing the electrical power supplied to a plurality of electronic devices electrically coupled to said alarm clock according to predetermined criteria if the person is motionless.

4. The method as claimed in claim 1, wherein said method further comprises the step of:

deactivating the alarm clock signals of said alarm clock if the person is not motionless.

5. The method as claimed in claim 1, wherein the behavior of the person is tracked with cameras.

6. The method as claimed in claim 1, wherein the behavior of the person is tracked with sensors.

7. A method for adjusting alarm clock signals, the method comprising the steps of:

(a) tracking behavior of a person in a predetermined area under surveillance after the activation of an alarm clock;

(b) determining whether the person is motionless within a first predetermined time period; and (c) if motionless, gradually increasing the alarm clock signals of said alarm clock, wherein said method further comprises the step of:

gradually decreasing the alarm clock signals of said alarm clock if the person is not motionless.

8. A method for adjusting alarm clock signals, the method comprising the steps of:

(a) tracking behavior of a person in a predetermined area under surveillance after the activation of an alarm clock;

(b) determining whether the person is motionless within a first predetermined time period; and, (c) if motionless, gradually increasing the alarm clock signals of said alarm clock, wherein said method further comprises the step of:

gradually decreasing the electrical power supplied to a plurality of electronic devices electrically coupled to said alarm clock according to predetermined criteria if the person is not motionless.

9. A method for adjusting the wake-up signals of an alarm clock to assist in awaking a person, the method comprising the steps of:

(a) setting a wake-up time in said alarm clock to activate the wake-up signals when the set time matches a current time;

(b) determining whether the person is motionless for a first predetermined time period after the activation of said alarm clock by tracking the person's overall behavior in a predetermined area under surveillance;

(c) gradually increasing the wake-up signals of said alarm clock for a second predetermined time period if it is determined that the person is motionless for the first predetermined time period;

(d) monitoring the overall behavior of the person for a third predetermined time period; and, (e) further increasing the wake-up signals of said alarm clock for a fourth predetermined time period if it is determined that the person is motionless for the third predetermined time period.

10. The method as claimed in claim 9, wherein said method further comprises the step of:

gradually increasing the electrical power supplied to a plurality of electronic devices electrically coupled to said alarm clock according to predetermined criteria if the person is motionless.

11. The method claimed in claim 9, wherein said method further comprises the step of:

deactivating said alarm clock if the person is not motionless.

12. The method claimed in claim 9, wherein the wake-up signals include a beeping sound, radio music, light or any combination thereof.

13. A method for adjusting the wake-up signals of an alarm clock to assist in awaking a person, the method comprising the steps of:

(a) setting a wake-up time in said alarm clock to activate the wake-up signals when the set time matches a current time;

(b) determining whether the person is motionless for a first predetermined time period after the activation of said alarm clock by tracking behavior in a predetermined area under surveillance;

(c) if motionless, gradually increasing the wake-up signals of said alarm clock for a second predetermined time period;

(d) monitoring behavior of the person for a third predetermined time period; and, (e) if motionless, further increasing the wake-up signals of said alarm clock for a fourth predetermined time period, wherein said method further comprises the step of:

gradually decreasing the wake-up signals of said alarm clock if the person is not motionless.

14. A method for adjusting the wake-up signals of an alarm clock to assist in awaking a person, the method comprising the steps of:

(a) setting a wake-up time in said alarm clock to activate the wake-up signals when the set time matches a current time;

(b) determining whether the person is motionless for a first predetermined time period after the activation of said alarm clock by tracking behavior in a predetermined area under surveillance;

(c) if motionless, gradually increasing the wake-up signals of said alarm clock for a second predetermined time period;

(d) monitoring behavior of the person for a third predetermined time period; and, (e) if motionless, further increasing the wake-up signals of said alarm clock for a fourth predetermined time period, wherein said method further comprises the step of:

gradually decreasing the electrical power supplied to a plurality of electronic devices electrically coupled to said alarm clock according to predetermined criteria if the person is not motionless.

15. An alarm clock system for adjusting wake-up signals, said alarm clock system comprising:

detecting means for observing the overall behavior of a person in a predetermined area under surveillance;

analyzing means for analyzing an output series of frame data from said detecting means to determine whether the person is motionless for a predetermined time period;

a speaker coupled to said analyzing means for producing said wake-up signals; and, control means for generating a control signal to gradually increase or decrease said wake-up signals based on whether or not the person is motionless.

16. The alarm clock system as claimed in claim 15, wherein said alarm clock system further comprises:

adjusting means for adjusting the electrical power supplied to a plurality of said devices electrically coupled to said control means.

17. The alarm clock system as claimed in claim 15, wherein said alarm clock system further comprises:

means for setting an alarm time.

18. The alarm clock system as claimed in claim 15, wherein said alarm clock system further comprises:

a solar power source, a battery power source, or an AC power source.

19. The alarm clock system as claimed in claim 15, wherein said observing means includes cameras.

20. The alarm clock system as claimed in claim 15, wherein said observing means includes sensors.

21. The alarm clock system as claimed in claim 15, wherein the wake-up signals includes a beeping sound, music, light or any combination of thereof.

* * * * *